US006829796B2

(12) United States Patent
Salvatini et al.

(10) Patent No.: US 6,829,796 B2
(45) Date of Patent: Dec. 14, 2004

(54) INTEGRATED BARRIER AND FLUID SUPPLY FOR A HOSPITAL BED

(75) Inventors: Benjamin Salvatini, Summerville, SC (US); Steven J. Schwartz, Cincinnati, OH (US); Reza Hakamiun, Charleston, SC (US); Todd O'Neal, Fairfield, OH (US); Kevin H. Grosse, Lawrenceburg, IN (US); Steven Caldwell, Jacksonville, FL (US)

(73) Assignee: Hill-Rom Services, Inc., Wilmington, DE (US)

( * ) Notice: Subject to any disclaimer, the term of this patent is extended or adjusted under 35 U.S.C. 154(b) by 31 days.

(21) Appl. No.: 10/261,771

(22) Filed: Oct. 1, 2002

(65) Prior Publication Data

US 2003/0061664 A1 Apr. 3, 2003

Related U.S. Application Data

(60) Provisional application No. 60/375,874, filed on Apr. 26, 2002, and provisional application No. 60/326,500, filed on Oct. 2, 2001.

(51) Int. Cl.[7] ..... A47C 27/08

(52) U.S. Cl. ..... 5/713; 5/710; 5/706

(58) Field of Search ..... 5/710–713, 724, 5/706

(56) References Cited

U.S. PATENT DOCUMENTS

| | | | |
|---|---|---|---|
| 4,051,522 | A | 9/1977 | Healy et al. |
| 4,539,560 | A | 9/1985 | Fleck et al. |
| 4,633,237 | A | 12/1986 | Tucknott et al. |
| 4,638,519 | A | 1/1987 | Hess |
| 4,793,428 | A | 12/1988 | Swersey |
| 4,862,921 | A | 9/1989 | Hess |
| 4,907,845 | A | 3/1990 | Wood |
| 4,926,951 | A | 5/1990 | Carruth et al. |
| 4,934,468 | A | 6/1990 | Koerber, Sr. et al. |
| 4,953,244 | A | 9/1990 | Koerber, Sr. et al. |
| 4,974,692 | A | 12/1990 | Carruth et al. |
| 5,051,673 | A | 9/1991 | Goodwin |
| 5,182,826 | A | 2/1993 | Thomas et al. |
| 5,235,319 | A | 8/1993 | Hill et al. |
| 5,267,364 | A | 12/1993 | Volk |
| 5,269,388 | A | 12/1993 | Reichow et al. |
| 5,276,432 | A | 1/1994 | Travis |
| 5,279,010 | A | 1/1994 | Ferrand et al. |
| 5,335,313 | A | 8/1994 | Douglas |
| 5,393,935 | A | 2/1995 | Hasty et al. |
| 5,410,297 | A | 4/1995 | Joseph et al. |
| 5,425,148 | A | 6/1995 | Ashcraft et al. |
| 5,586,346 | A | 12/1996 | Stacy et al. |
| 5,611,096 | A | 3/1997 | Bartlett et al. |
| 5,623,736 | A | 4/1997 | Soltani et al. |
| 5,647,079 | A | 7/1997 | Hakamiun et al. |
| 5,699,038 | A | 12/1997 | Ulrich et al. |
| 5,715,548 | A | 2/1998 | Weismiller et al. |
| 5,771,511 | A | 6/1998 | Kummer et al. |
| 5,802,640 | A | 9/1998 | Ferrand et al. |
| 5,808,552 | A | 9/1998 | Wiley et al. |
| 5,906,016 | A | 5/1999 | Ferrand et al. |
| 5,906,017 | A | 5/1999 | Ferrand et al. |
| 5,944,494 | A | 8/1999 | Soltani et al. |
| 5,971,913 | A | 10/1999 | Newkirk et al. |
| 6,021,533 | A | 2/2000 | Ellis et al. |
| 6,047,424 | A | 4/2000 | Osborne et al. |

(List continued on next page.)

FOREIGN PATENT DOCUMENTS

| | | |
|---|---|---|
| EP | 0 860 803 | 8/1998 |

*Primary Examiner*—Teri Pham Luu
(74) *Attorney, Agent, or Firm*—Bose McKinney & Evans LLP

(57) ABSTRACT

A patient support apparatus including a barrier coupled to a frame. The barrier includes an interior region containing a fluid supply. A related method is provided for converting a patient support apparatus to include a fluid filled patient support surface.

46 Claims, 12 Drawing Sheets

U.S. PATENT DOCUMENTS 6,067,019 A 5/2000 Scott
6,073,289 A 6/2000 Bolden et al.
6,158,070 A 12/2000 Bolden et al.
6,178,576 B1 1/2001 Newell
6,208,250 B1 3/2001 Dixon et al.
6,212,718 B1 4/2001 Stolpmann et al.
6,290,194 B1 9/2001 Chaconas et al.
6,295,675 B1 10/2001 Ellis et al.
6,320,510 B2 11/2001 Menkedick et al.
6,321,878 B1 11/2001 Mobley et al.
6,353,948 B1 3/2002 Bolden et al.
6,438,776 B2 8/2002 Ferrand et al.
6,467,111 B1 10/2002 Vrzalik et al.
6,467,113 B2 10/2002 Ellis et al.
2001/0001163 A1 5/2001 Allen et al.

INTEGRATED BARRIER AND FLUID SUPPLY FOR A HOSPITAL BED

CROSS-REFERENCE TO RELATED APPLICATIONS

This application claims the benefit of U.S. Provisional Patent Application Ser. No. 60/375,874, filed Apr. 26, 2002, and U.S. Provisional Patent Application Ser. No. 60/326,500, filed Oct. 2, 2001, the disclosures of which are expressly incorporated by reference herein.

BACKGROUND AND SUMMARY OF THE INVENTION

The present invention relates to a patient support apparatus and a related method for converting a patient support apparatus. More particularly, the present invention relates to a patient support apparatus which includes a fluid filled patient support surface, such as an air mattress, and a fluid supply located in a barrier, such as a footboard, coupled to the patient support surface. Further, the present invention relates to a method of converting a patient support apparatus to include a fluid filled patient support surface.

In an illustrated embodiment of the present invention, a patient support apparatus comprises a base, a frame coupled to the base, and a fluid filled mattress supported by the frame. The mattress has a top surface configured to support a person thereon. The patient support apparatus also includes a barrier coupled to the frame and having a portion which extends above the top surface of the mattress, and a fluid supply located in an interior region of the barrier. The fluid supply is configured to supply fluid to the mattress.

Illustratively according to the embodiment, the fluid supply includes at least one valve located within the interior region of the barrier.

Further illustratively according to the embodiment, a controller is coupled to the fluid supply and is located within the interior region of the barrier. A second controller is illustratively coupled to one of the base and the frame, wherein the second controller is electrically coupled to the controller in the interior region of the barrier.

Illustratively according to the embodiment, the barrier is removable from the frame. A first connector is located on the barrier and a second connector is located on the frame, the first connector being configured to mate with the second connector to provide an electrical connection to the barrier when the barrier is installed on the frame.

Further illustratively according to the embodiment, the fluid supply is one of a blower and a compressor.

Illustratively according to the embodiment, the fluid supply is a water pump.

Further illustratively according to the embodiment, the barrier includes a receptacle formed in the interior region and configured to receive an accessory item therein.

Illustratively according to the embodiment, the barrier includes a fluid intake to supply fluid to the fluid supply through the barrier.

Further illustratively according to the embodiment, the barrier is one of a footboard, a headboard, and a siderail.

In another illustrated embodiment of the present invention, a method is provided for converting a bed to include a fluid filled mattress. The method includes the steps of providing a bed having a frame for supporting a mattress and providing a first footboard coupled to the frame. The method further comprises the steps of supporting a fluid filled mattress by the frame, replacing the first footboard with a second footboard having a fluid supply located within an interior region of the second footboard, and connecting the fluid supply located in the interior region of the second footboard to the fluid filled mattress.

Illustratively according to the embodiment, the bed includes an articulating deck and the first footboard includes controls for moving the articulating deck. The second footboard includes controls for moving the articulating deck and controls for the mattress.

Further illustratively according to the embodiment, the fluid supply includes at least one valve located within the interior region of the second footboard, the valve being configured to direct fluid to the mattress.

Illustratively according to the embodiment, a controller is coupled to the fluid supply and is located within the interior region of the second footboard.

Further illustratively according to the embodiment, the fluid supply is one of a blower and a compressor.

In yet another illustrated embodiment of the present invention, a barrier apparatus is configured to be coupled to a patient support including a mattress having a top surface configured to support a person thereon. The barrier apparatus includes a housing configured to define an interior region, a fluid supply located in the interior region of the housing, and a coupler configured to secure the housing to the patient support so that the housing is located adjacent the mattress with a portion of the housing extending above the top surface of the mattress to provide a barrier for the person on the top surface of the mattress. The fluid supply is coupled to a fluid filled device.

Illustratively according to the embodiment, the housing is formed by one of a footboard, a headboard, and a siderail.

Further illustratively according to the embodiment, at least one valve is located within the interior region of the housing. The at least one valve is configured to direct fluid to the fluid filled device.

Illustratively according to the embodiment, a controller is coupled to the fluid supply and is located within the interior region of the housing. A second controller is illustratively coupled to the patient support and is electrically coupled to the controller in the interior region of the housing.

Further illustratively according to the embodiment, the housing is removable from the patient support. A first connector is located on the housing and a second connector is located on the patient support, the first connector being configured to mate with the second connector to provide an electrical connection to the housing when the housing is installed on the patient support.

Illustratively according to the embodiment, the fluid supply is one of a blower, a compressor, and a water pump.

Illustratively according to the embodiment, the housing includes a receptacle formed in the interior region and configured to receive an accessory item therein.

Further illustratively according to the embodiment, the housing includes a fluid intake to supply fluid to the fluid supply through the housing.

Illustratively according to the embodiment, a therapy control module is coupled to the housing to provide therapy on the person. The therapy control module is illustratively located in the interior region of the housing.

Illustratively according to the embodiment, the fluid filled device is an air mattress or a therapy device.

In a further illustrated embodiment of the present invention, a barrier apparatus is configured to be coupled to a patient support including a mattress having a top surface configured to support a person thereon. The barrier apparatus includes a housing having a front wall, a rear wall, and a cavity formed intermediate the front wall and the rear wall. The barrier apparatus further includes a bumper extending outwardly from the front wall, the bumper including a support located in the cavity and extending toward the front wall of the housing, and a coupler configured to secure the housing to the patient support so that the housing is located adjacent the mattress with a portion of the housing extending above the top surface of the mattress to provide a barrier for the person on the top surface of the mattress.

According to the illustrated embodiment, the bumper includes a resilient engagement member aligned with the support and extending outwardly from the front wall of the housing.

Illustratively according to the embodiment, the support of the bumper includes a body portion coupled to a pair of support posts.

Further illustratively according to the embodiment, a mounting bracket is supported within the cavity intermediate the front wall and the rear wall of the housing, wherein the support of the bumper is coupled to the mounting bracket.

Illustratively according to the embodiment, a fluid supply is located in the cavity of the housing and is coupled to a fluid filled device. At least one valve is illustratively located within the interior region of the housing and is configured to direct fluid to the fluid filled device.

Further illustratively according to the embodiment, the housing is formed by one of a footboard, a headboard, and a siderail.

Illustratively according to the embodiment, the housing is removable from the patient support. A first connector is located on the housing and a second connector is located on the patient support, the first connector being configured to mate with the second connector to provide an electrical connection to the housing when the housing is installed on the patient support.

In yet another illustrated embodiment of the present invention, a footboard is configured to be coupled to a patient support including a mattress having a top surface configured to support a person thereon. The footboard comprises a body including an outer surface, a fluid outlet formed within the outer surface of the body, and a coupler configured to secure the body to the patient support so that the body is located adjacent the mattress with a portion of the body extending above the top surface of the mattress to provide a barrier for the person on the top surface of the mattress.

Illustratively according to the embodiment, a fluid inlet is formed within the outer surface of the body, the fluid inlet being in fluid communication with the fluid outlet.

Further illustratively according to the embodiment, the fluid outlet includes tubular member extending outwardly from the outer surface of the body, wherein the tubular member comprises a flexible hose including a plurality of fluid lines.

Illustratively according to the embodiment, a relief member is supported by the outer surface of the body, the tubular member passing through the relief member.

Further illustratively according to the embodiment, a fluid supply is supported by the body of the footboard and is coupled to a fluid filled device by the fluid outlet. The fluid outlet includes a first set of fluid connectors configured to couple with a second set of fluid connectors supported by the fluid filled device. The fluid outlet further comprises an alignment member so that the first and second sets of fluid connectors can be coupled together in a single orientation.

Illustratively according to the embodiment, at least one valve is supported by the body of the footboard and is configured to direct fluid to the fluid filled device.

Further illustratively according to the embodiment, the outer surface of the body includes a front surface and a rear surface. A bumper is supported by the front surface and the fluid outlet is supported by the rear surface.

Further illustratively according to the embodiment, the footboard is removable from the patient support.

Illustratively according to the embodiment, a first electrical connector is located on the body of the footboard and a second electrical connector is located on the patient support. The first electrical connector is configured to mate with the second electrical connector to provide an electrical connection to the footboard when the body is installed on the patient support.

In a further illustrated embodiment of the present invention, a barrier apparatus is configured to be coupled to a patient support including a mattress having a top surface configured to support a person thereon. The barrier apparatus comprises a body, and an instruction receptacle coupled to the body, the instruction receptacle including a pair of side walls defining an interior region, an open upper end in communication with the interior region, and an opposing lower end including a fluid passage in communication with the interior region. The barrier apparatus illustratively further comprises a coupler configured to secure the body to the patient support so that the body is located adjacent the mattress with a portion of the body extending above the top surface of the mattress to provide a barrier for the person on the top surface of the mattress.

Illustratively according to the embodiment, a guide member is coupled to the instruction receptacle, and a plurality of cards are coupled to the guide member for movement from within the interior region through the open upper end of the instruction receptacle.

Illustratively according to the embodiment, the guide member includes a pin supported within the interior region of the instruction receptacle, each of the plurality of cards including a slot configured to slidably receive the pin.

Further illustratively according to the embodiment, the body of the barrier apparatus is formed by one of a footboard, a headboard, and a siderail.

Illustratively according to the embodiment, the pair of sidewalls of the instruction receptacle each include an arcuate lower portion configured to direct fluid downwardly toward the fluid passage in the lower end of the instruction receptacle.

Further illustratively according to the embodiment, a fluid supply is supported by the body of the barrier apparatus and is coupled to a fluid filled device. At least one valve is supported by the body and is configured to direct fluid to the fluid filled device.

Illustratively according to the embodiment, the barrier is removable from the patient support.

Additional features of the invention will become apparent to those skilled in the art upon consideration of the following detailed description when taken in conjunction with the accompanying drawings.

BRIEF DESCRIPTION OF THE DRAWINGS

The detailed description of the drawings particularly refers to the accompanying figures in which.

DETAILED DESCRIPTION OF THE DRAWINGS

Figure 1:
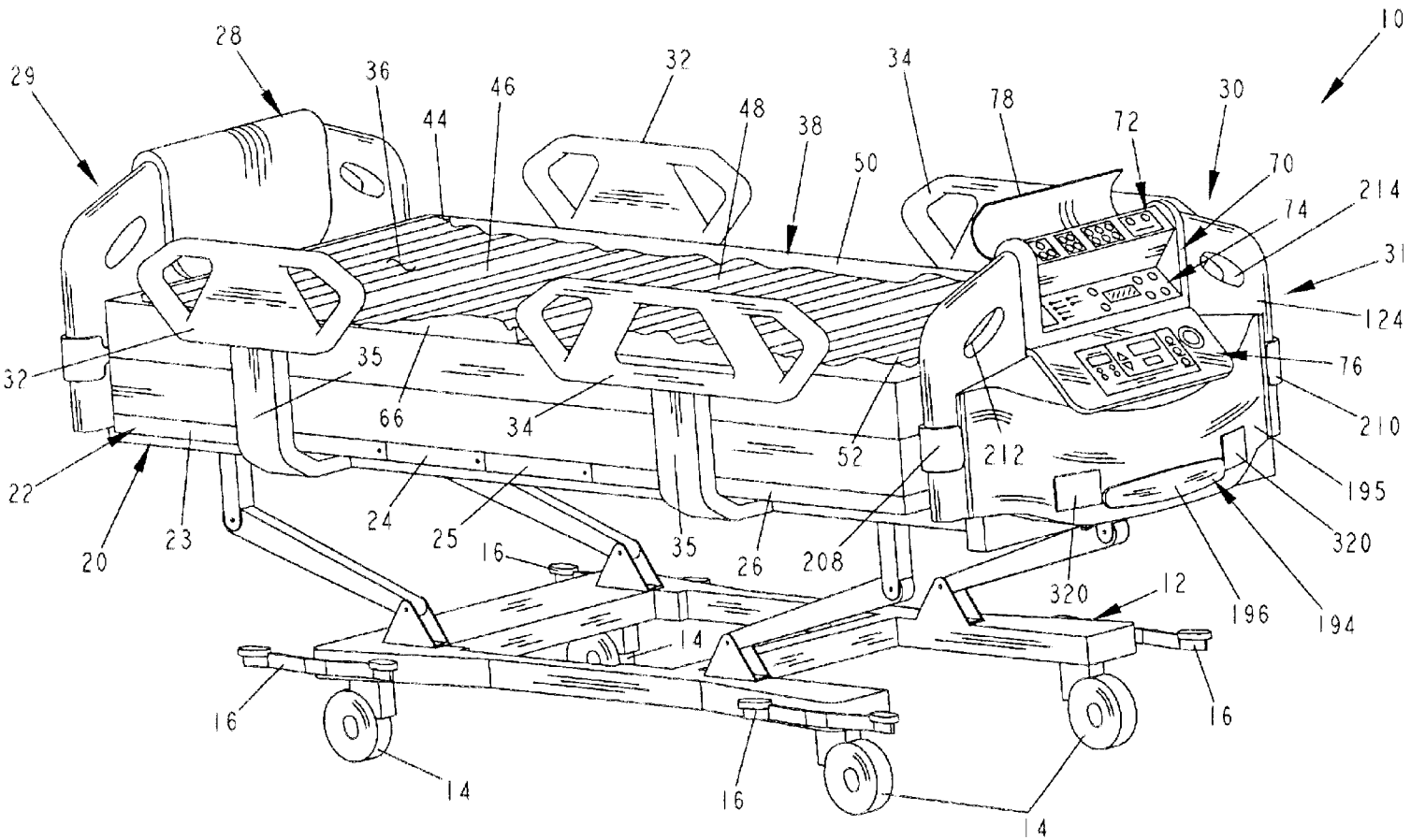
FIG. 1 is a perspective view of a hospital bed including a removable footboard of the present invention configured to include both bed frame and mattress controls, and a fluid supply, such as a blower or compressor, for supplying fluid to a fluid filled mattress on the bed.

Referring now to the drawings, FIG. 1 illustrates a hospital bed 10 of the present invention. The bed 10 includes a base frame 12 having a plurality of casters 14, and a brake/steer control mechanism having pedals 16 mounted adjacent each of the casters 14. Details of the structure and operation of the brake/steer control mechanism are disclosed in U.S. Pat. No. 6,321,878, which is assigned to the assignee of the present invention and the disclosure of which is expressly incorporated by reference herein.

The bed 10 further includes an elevating frame 20 coupled to the base frame 12, and an articulating deck 22 coupled to the elevating frame 20. The elevating frame 20 may include a retracting frame as illustrated in U.S. Pat. No. 6,208,250, which is assigned to the assignee of the present invention and the disclosure of which is expressly incorporated by reference herein. Furthermore, a weigh frame (not shown) of the type disclosed in U.S. Pat. No. 6,208,250 may be coupled to the base frame 12. The articulating deck 22 illustratively includes a head deck section 23, a seat deck section 24, a thigh deck section 25, and a leg deck section 26. The deck sections 23, 24, 25, and 26 are movable to various positions in a conventional manner.

A headboard 28 is mounted to the elevating frame 20 adjacent a head end 29 of bed 10, and a footboard 30 is mounted to the elevating frame 20 adjacent a foot end 31 of bed 10. In the illustrated embodiment and as described in greater detail below, the footboard 30 is removable from the frame 20. Additional details of the supporting structure facilitating removal of the footboard 30 from the frame 20 are illustrated in U.S. Pat. No. 6,208,250.

The bed 10 further includes a pair of head end siderails 32 and a pair of foot end siderails 34 coupled to the articulating deck 22 on opposite sides of the bed 10. The siderails 32 and 34 are coupled to the articulating deck 22 in a conventional manner using connector mechanisms 35, such as those described in detail in U.S. Pat. No. 6,208,250. The siderails 32 and 34 are each movable between a lowered position and an elevated position located above a top surface or patent support surface 36, as shown in FIG. 1.

Figure 2:
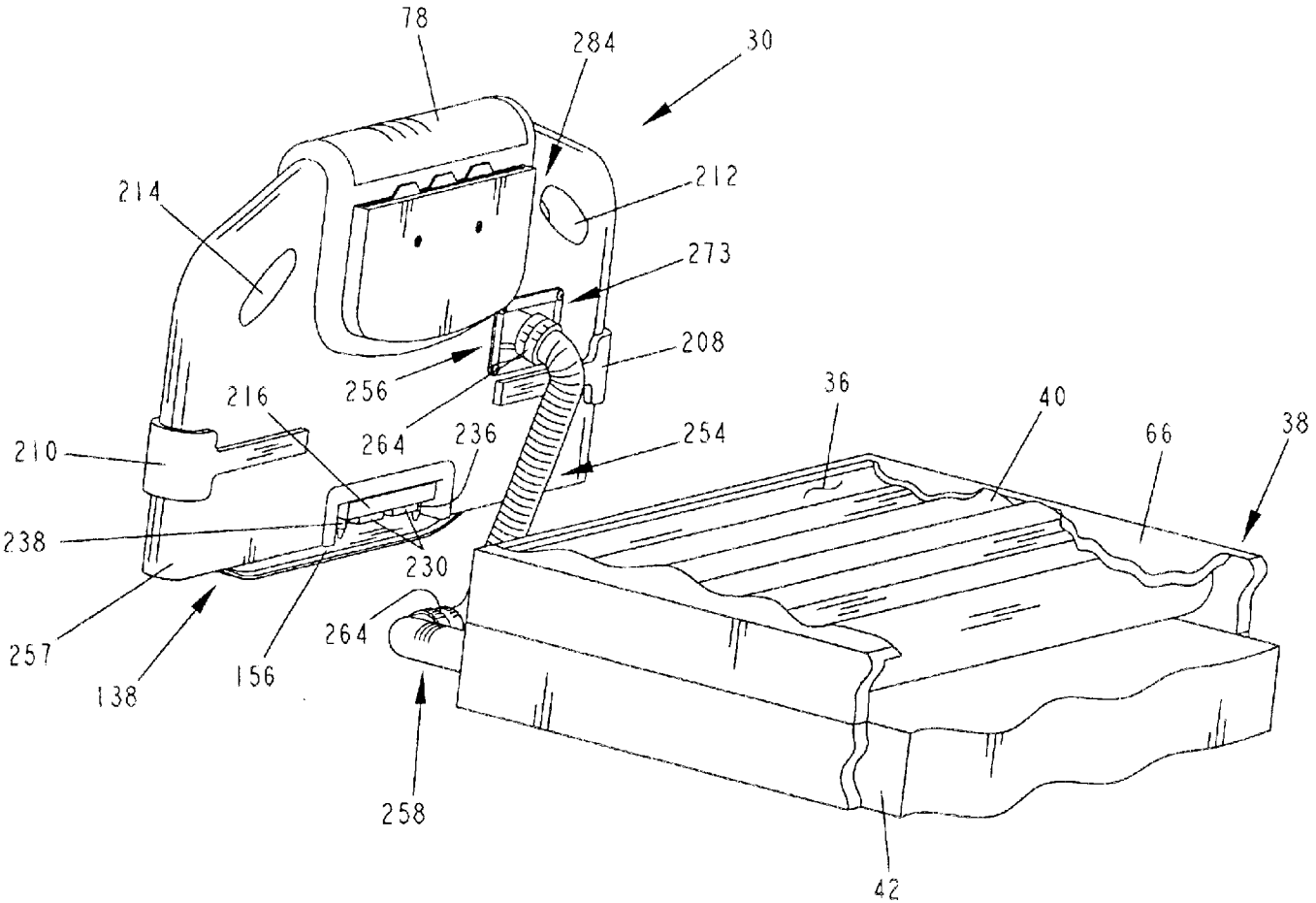
FIG. 2 is a partial perspective view illustrating the footboard of FIG. 1 coupled to a fluid filled mattress by a supply hose.
Figure 3:
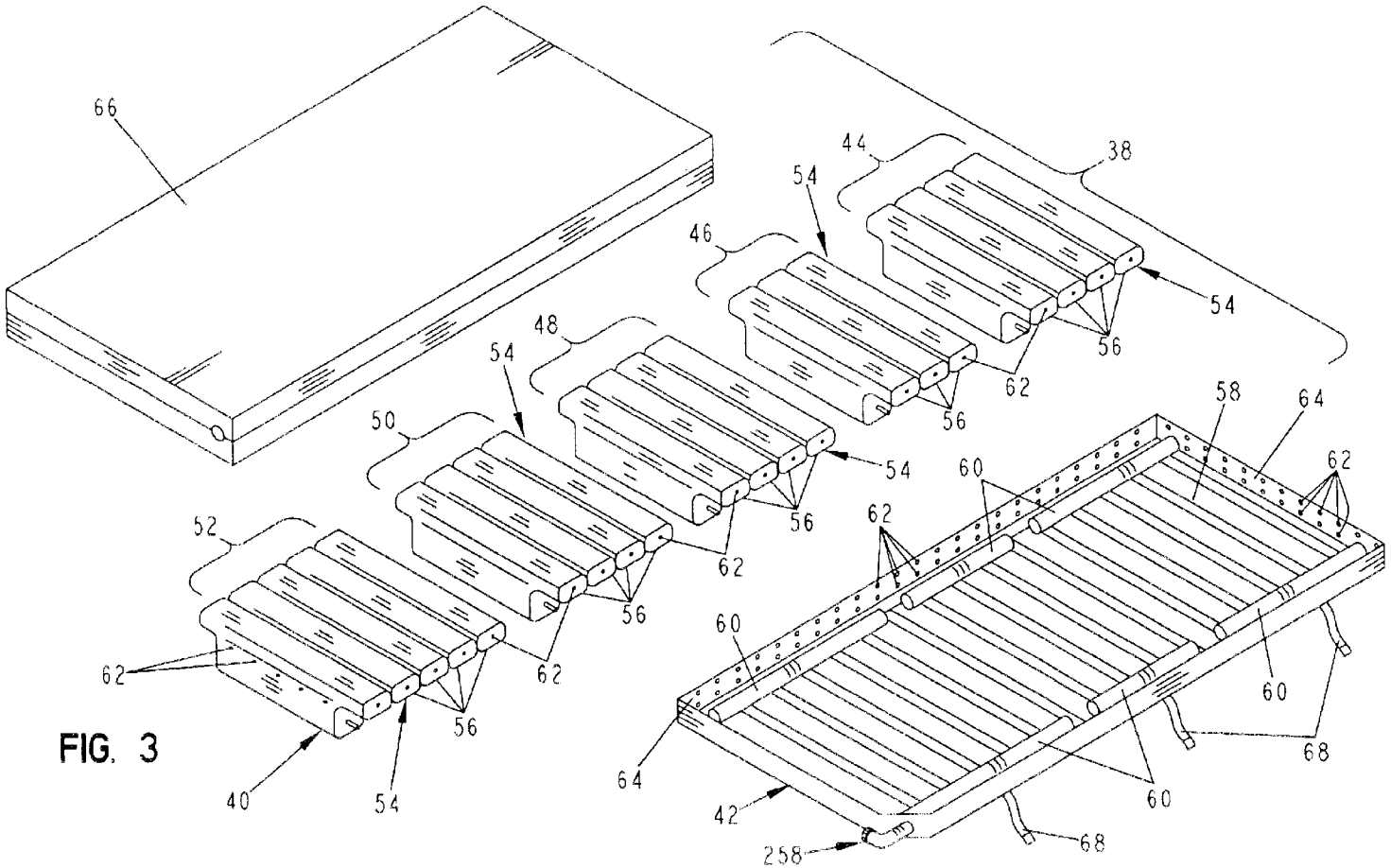
FIG. 3 is an exploded perspective view in partial schematic illustrating the various mattress zones of the fluid filled mattress of FIG. 1.

Referring now to FIGS. 1–3, the top surface 36 is defined by a mattress 38 located on the articulating deck 22 and is configured to support a patient thereon. Illustratively, the mattress 38 is an air mattress including upper and lower cushion levels or layers 40 and 42. The upper cushion level 40 provides a support surface for the patient and illustratively includes five separate groups or zones 44, 46, 48, 50, and 52 extending from the head end 29 to the foot end 31 of the bed 10 (FIGS. 1 and 3). The zones include a head zone 44, a chest zone 46, a seat zone 48, a thigh zone 50, and a foot zone 52. Each upper level zone 44, 46, 48, 50, and 52 may be formed by a single cushion 54 including a plurality of generally rectangularly-shaped air bag segments or bladders 56 which are in fluid communication with each other within a single cushion 54.

With further reference to FIG. 3, the lower cushion layer 42 illustratively includes a closed cell air bag or substrate 58 extending across the entire length and width of the elevating frame 20. A plurality of bolsters 60 may be formed on the lower substrate 58 along its side edges. The bolsters 60 are illustratively integrally formed with the lower substrate 58 so that the interiors of the bolsters 60 are in fluid communication with the remainder of the substrate 58.

When the upper and lower cushioning layers 40 and 42 are positioned in an overlaying relationship, the bolsters 60 nest within a space below the end portions of the bladders 56. Releasable securing devices, such as snaps 62, are used to join the ends and sides of the cushioning layers 40 and 42 to side panels 64 placed around the sides of the mattress 38. Thus, the side panels 64 tend to hold the bolsters 60 in place. The bolsters 60 tend to keep the upper cushioning layer 40 from shifting with respect to the lower cushioning layer 42. In addition to the side panels 64, a coverlet 66 also may be placed about the upper and lower cushioning layers 40 and 42 to help secure them together as a single unit.

The lower cushioning layer 42 may also include a plurality of side release members, such as tie downs 68, about its perimeter. The tie downs 68 are used to secure the mattress 38 to the articulating deck 22.

The mattress 38 is illustratively a low air loss mattress, although any type of air or fluid filled mattress may be used in accordance with the present invention. The low air loss mattress 38 provides controlled air leakage to allow a limited amount of air to escape from the upper and lower cushioning layers 40 and 42 of the mattress 38. Illustratively, the mattress 38 may be of the type disclosed in U.S. Pat. No. 5,647,079, which is assigned to the assignee of the present invention and which is expressly incorporated by reference herein.

Figure 4:
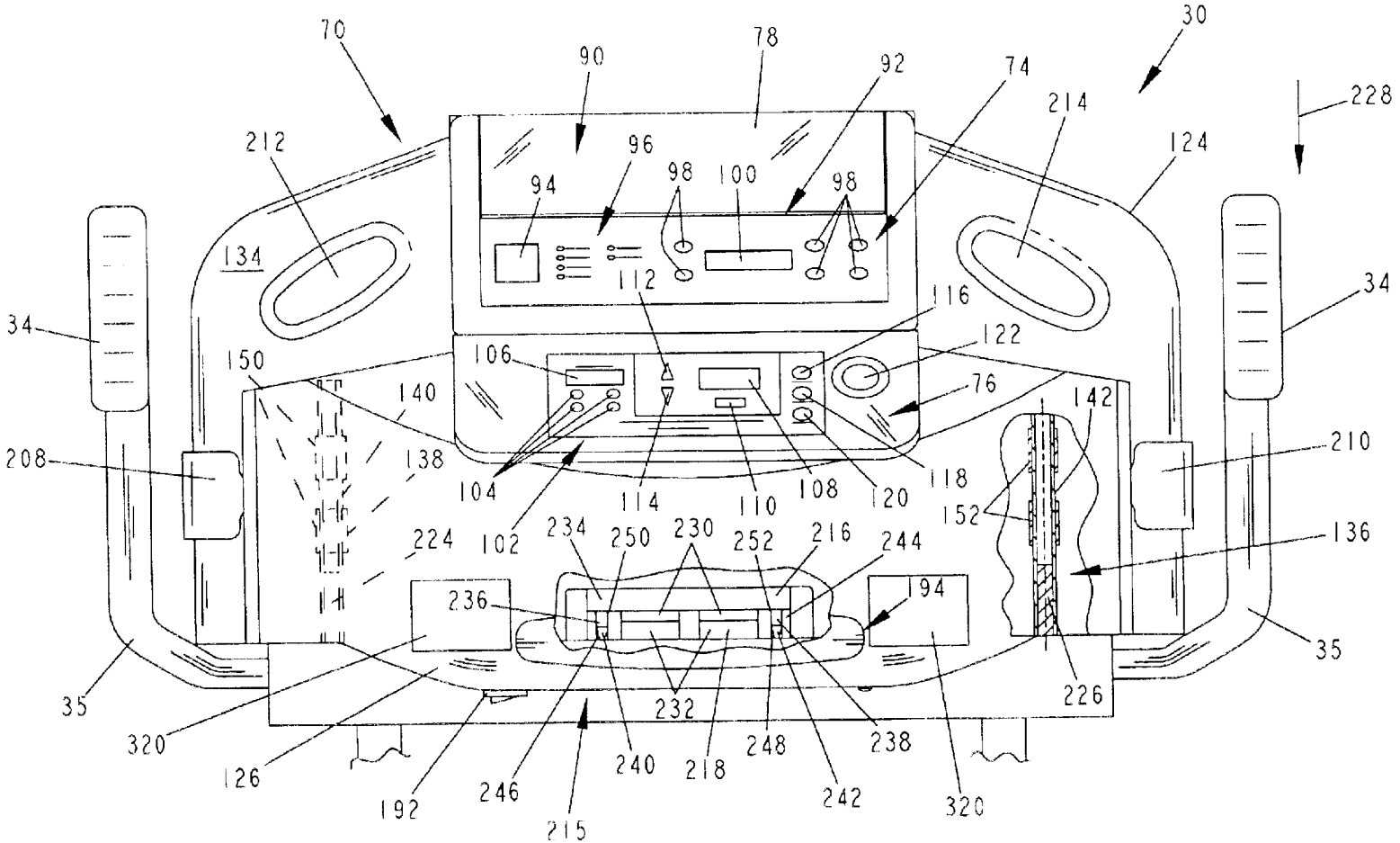
FIG. 4 is a front elevational view, with partial cut-aways, illustrating the removable footboard of FIG. 1.
Figure 5:
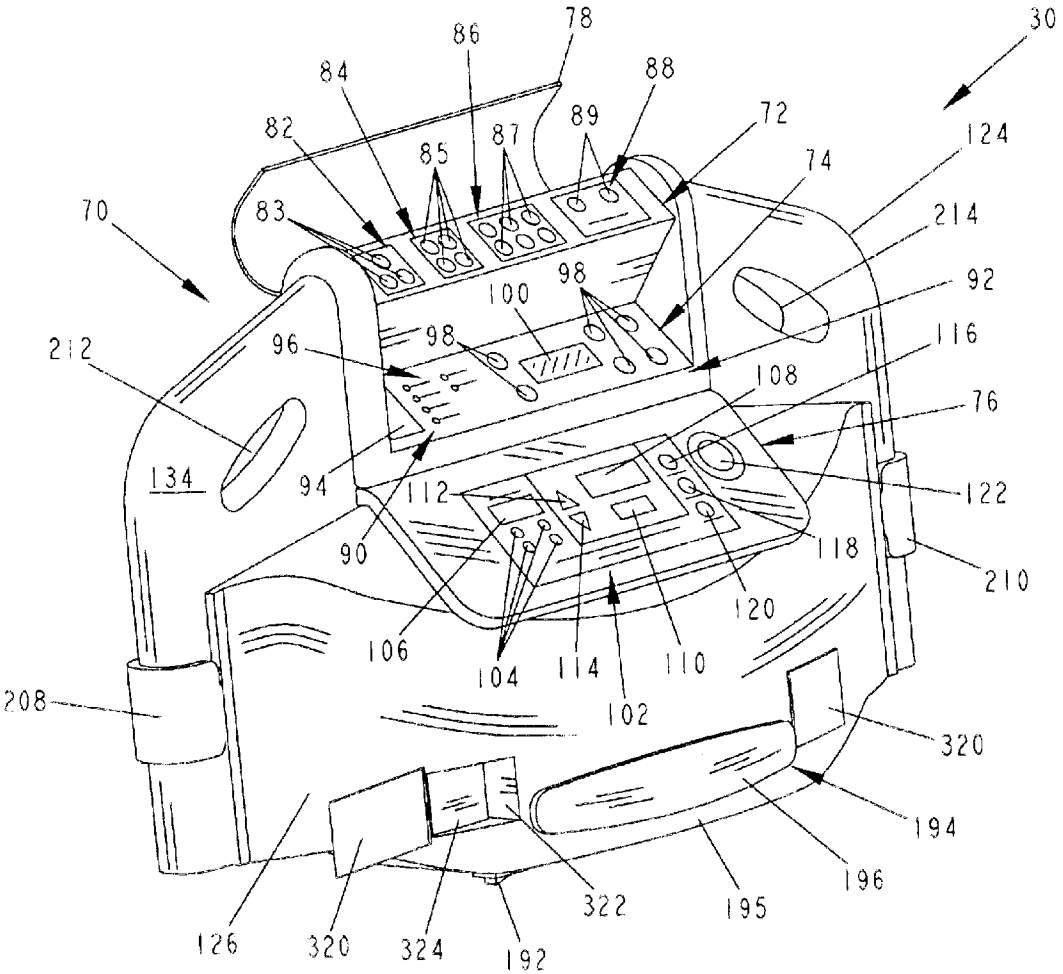
FIG. 5 is a front perspective view of the removable footboard of FIG. 1 illustrating further details thereof.

With reference to FIGS. 1, 4 and 5, the footboard 30 includes a plurality of controls 70, such as buttons, knobs, or switches for controlling various functions of the bed 10 and of devices associated with the bed 10. The controls 70 are supported on a top inclined panel 72, a central inclined panel 74 and a lower inclined panel 76. A cover 78 is pivotably coupled to the footboard 30 by a pivot connection 80 (FIG. 7) so that the cover 78 can be pivoted downwardly to conceal at least those of the controls 70 located on the top inclined panel 72.

With reference to FIG. 5, the controls 70 supported by the top inclined panel 72 include a plurality of environment or accessory controls 82, a plurality of lock out controls 84, a plurality of bed position controls 86, and a plurality of surface controls 88. The accessory controls 82 may include conventional push buttons 83 configured to activate and deactivate an entertainment device, such as a television or a radio, a night light, or a back light.

The lock out controls 84 may include conventional push buttons 85 configured to permit a caregiver to lock out selected functions normally controlled by a patient using patient controls (not shown) that are typically located on the head end side rails 32. For example, the lock out buttons 85 may deactivate controls for head or knee articulation of the articulating deck 22, and for a conventional high-low mechanism (not shown). Additionally, the lock out buttons 85 may deactivate controls for entertainment devices or lights of the type discussed above. A master lock out button 85 may be provided to lock out all of the motors for controlling head and knee articulation and the high-low mechanism.

The bed position controls 86 may include conventional push buttons 87 configured to permit a caregiver to select preset configurations for the articulating deck 22, and to raise or lower the elevating frame 20. The bed position controls 86 may further include buttons 87 to place the elevating frame 20 in either Trendelenburg or Reverse Trendelenburg positions. The surface controls 88 may comprise conventional push buttons 89 configured to activate and deactivate the air mattress 38, or to provide an automatic firm pressure setting of the air mattress 38.

The central inclined panel 74 includes a plurality of indicators 90, and in-bed scale controls 92. The indicators 90 illustratively include a Trendelenburg angle indicator 94 including an indicator member (not shown) supported for relative movement as the angular orientation of the bed frame 20 changes. Also included are a plurality of indicator lights 96, illustratively light emitting diodes (LEDs), which may provide an indication of a plurality of different conditions, such as motor power off, ground loss, brake not set, bed not down, service required, and surface power off. The in-bed scale controls 92 may include a plurality of conventional push buttons 98 configured to, for example, activate and deactivate a scale coupled to the weigh frame, reset the scale, and convert the units of measure. An indicator 100, illustratively a liquid crystal display, is positioned adjacent the buttons 98 and is configured to display information associated with the in-bed scale.

The lower inclined panel 76 supports a plurality of air mattress controls 102 which are configured to allow a caregiver to control operation of the air mattress 38. For example, the air mattress controls 102 may adjust pressure in the various zones 44, 46, 48, 50, and 52 of the mattress 38 or provide therapy to the patient supported on the air mattress 38. The air mattress controls 102 include a plurality of programming control buttons 104 associated with a display 106 for entering or adjusting a patient's height and weight. A controller 107 (FIG. 12) is illustratively provided to automatically set the air zone pressures at base line pressures based upon the patient's height and weight.

The air mattress controls 102 further includes a zone pressure indicator 108 for providing an indication of the pressure supplied to each respective air zone 44, 46, 48, 50, and 52 of the air mattress 38. Illustratively, the indicator 108 may comprise a plurality of light emitting diodes (not shown) which are illuminated to provide a representation of pressure relative to base line pressures. A zone select button 110 is provided below the indicator 108 and permits the caregiver to select a particular air zone 44, 46, 48, 50, or 52 for pressure adjustment. Pressure adjust buttons 112 and 114 are positioned adjacent to the indicator 108 and are configured to permit the caregiver to manually increase or decrease, respectively, the pressure in the zone selected by the zone selection button 110. A max inflate button 116 is likewise provided adjacent to the indicator 108 and may be depressed to cause maximum inflation of all air zones 44, 46, 48, 50, and 52 of the air mattress 38, thereby providing a firmer support surface for the patient. A seat deflate button 118 is provided immediately below the max inflate button 116 and may be depressed by a caregiver to deflate the seat zone 48 and the thigh zone 50 of the air mattress 38. Deflation of the seat zone 48 and the thigh zone 50 may be utilized, for example, when moving a patient to or from the bed 10.

The air mattress controls 102 further include an alarm silence button 120. Should the controller 107 detect an operational problem, an audible alarm 121 (FIG. 12), such as a bell or buzzer, is illustratively activated. Depressing the alarm silence button 120 causes the audible alarm 121 to be temporarily silenced. A highly visible CPR button 122 is supported on the lower inclined panel 76. Depression of the CPR button 122 results in a rapid deflation of all air zones 44, 46, 48, 50, 52 and 58 as described in greater detail below. The CPR button 122 is illustratively larger than the other controls 70 and may be identified by a color, such as red, distinct from the other controls 70.

Figure 6:
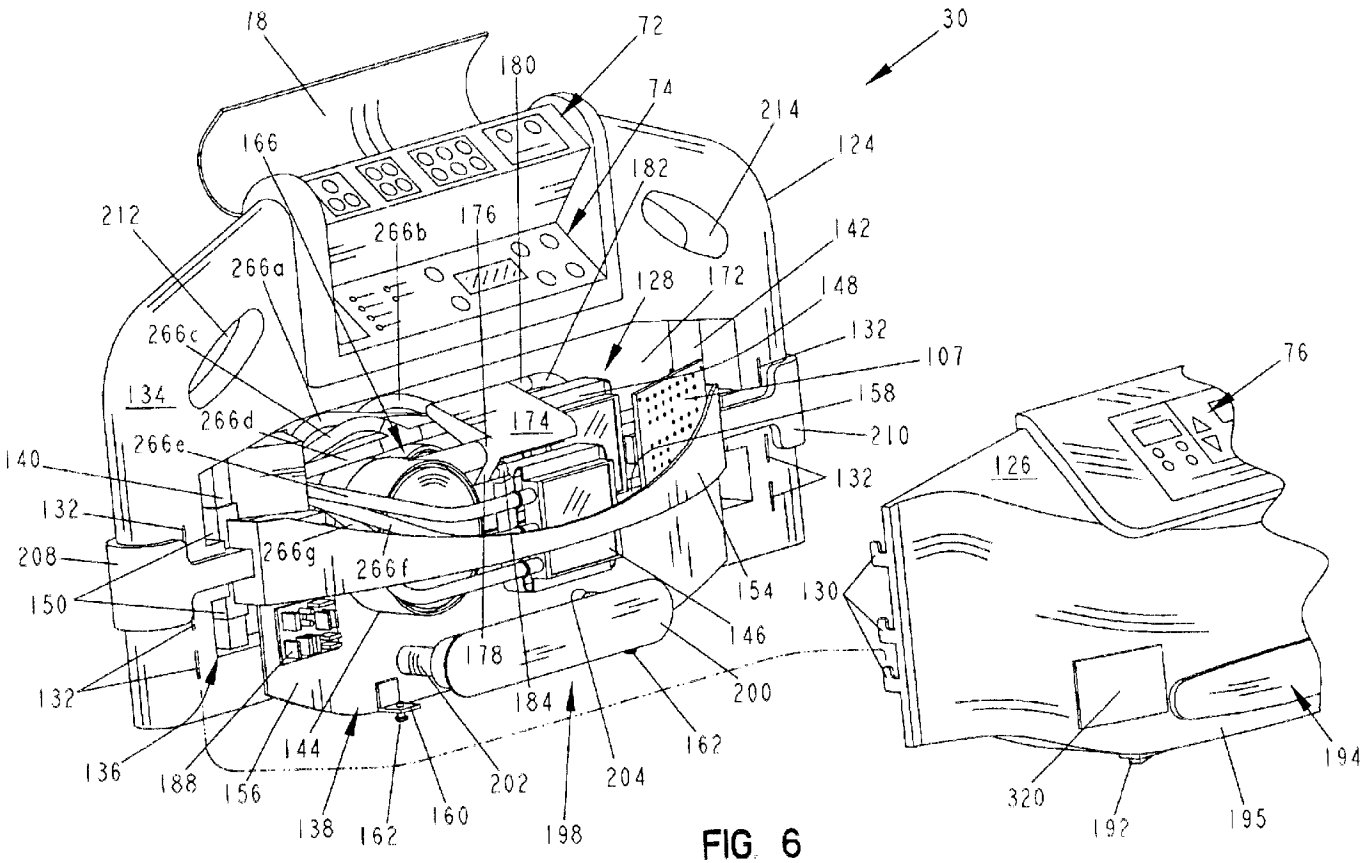
FIG. 6 is a front perspective view of the footboard similar to FIG. 5, with the front cover removed.

As best shown in FIGS. 4–6 and 8, the footboard 30 includes a housing or body 124 supporting a removable cover 126 which encloses an interior region or chamber 128 (FIG. 6). The removable cover 126 includes a releasable securing device, illustratively a plurality of L-shaped locking tabs 130 disposed adjacent opposing side edges of the cover 126 , for releasably securing the cover 126 to the body portion 124. Moreover, the locking tabs 130 are receivable within a plurality of receiving slots 132 formed within an outer surface 134 of the body portion 124 (FIG. 6). The removable cover 126 supports the lower inclined panel 76 and includes an air inlet or intake 135. The air intake 135 is illustratively formed as a grille in a lower portion of the removable cover 126 and provides fluid communication between atmosphere and the interior region 128 of the footboard 30 (FIG. 9).

Figure 8:
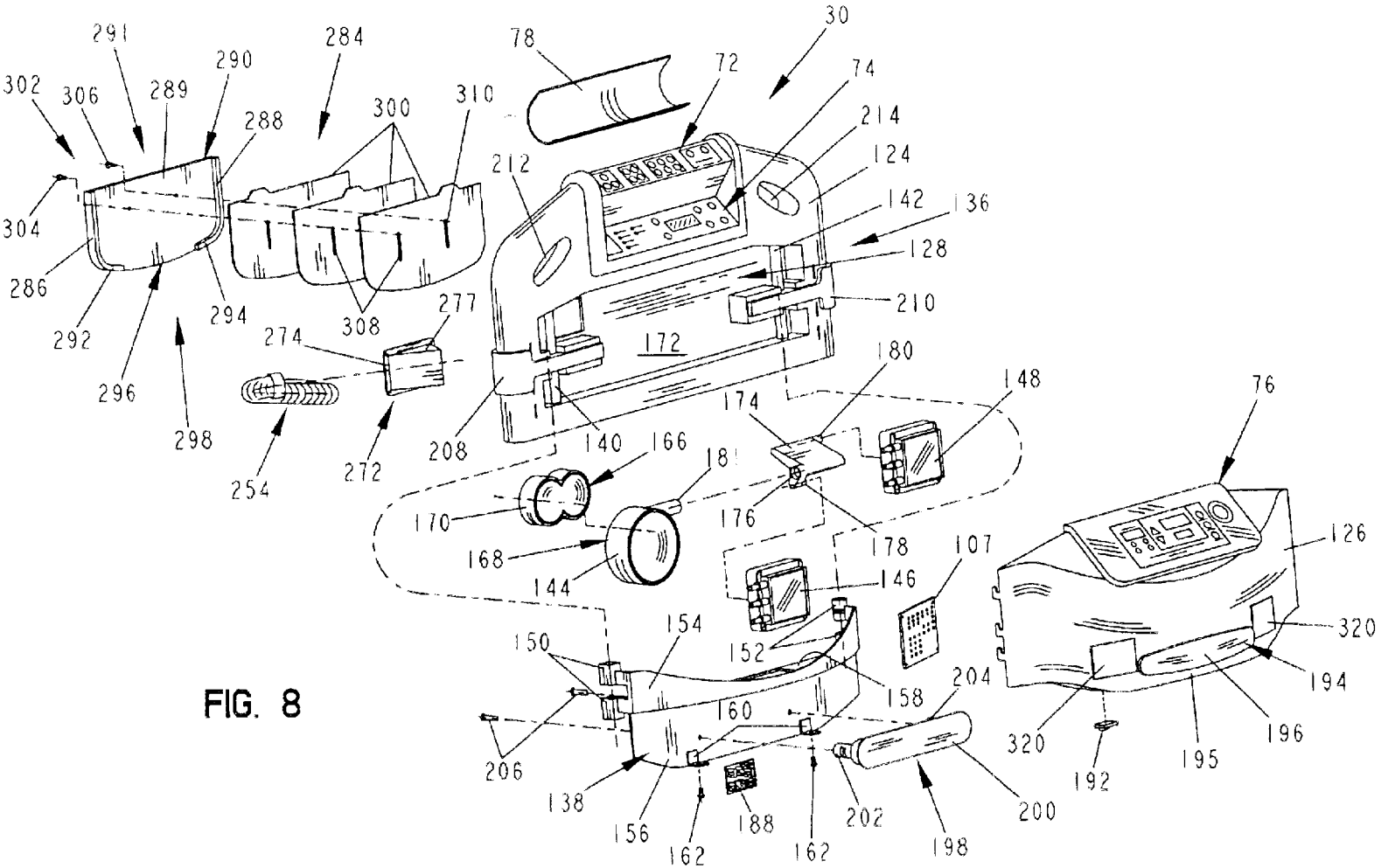
FIG. 8 is an exploded perspective view of the removable footboard of FIG. 1.
Figure 9:
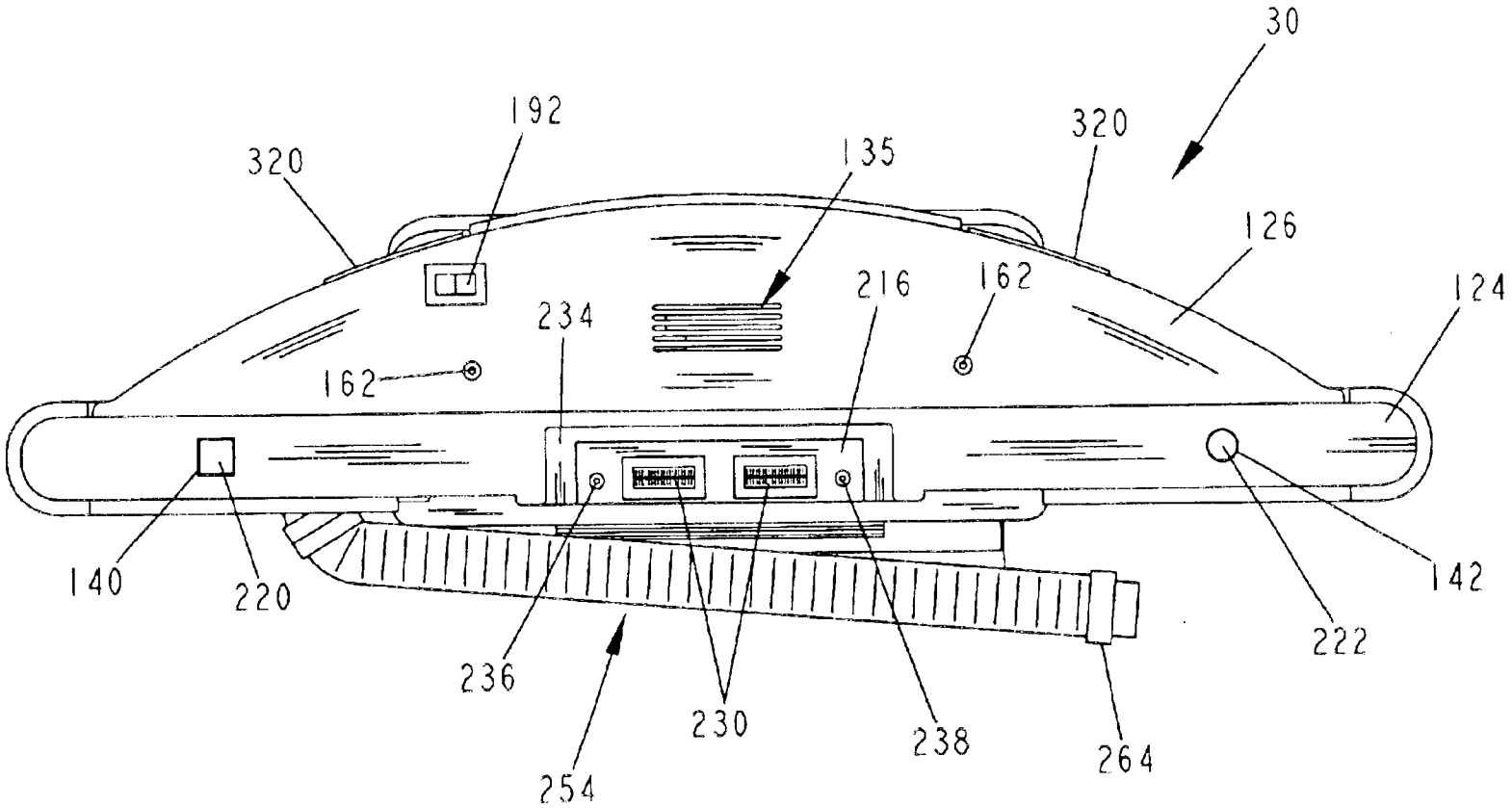
FIG. 9 is a bottom plan view of the removable footboard of FIG. 1.

Referring further to FIGS. 4, 6, and 8, an internal frame 136 includes a mounting member or bracket 138 extending between a pair of spaced apart support posts 140 and 142 within the interior region 128. The left support post 140 comprises a tubular member having a substantially rectangular cross-section, while the right support post 142 comprises a tubular member having a substantially circular cross-section. As detailed below, the different cross-sectional shapes of the support posts 140 and 142 facilitate proper orientation of the footboard 30 on the bed frame 20. The mounting member 138 is configured to support internal pneumatic and electrical components, including a blower 144 and first and second air control valves 146 and 148 which are coupled to the blower 144 within the interior region 128 of the footboard 30.

The mounting member 138 is secured to the left and right support posts 140 and 142 through left and right collars 150 and 152, respectively. The left and right collars 150 and 152, in turn, are fixed to an arcuate support 154 extending outwardly away from the body portion 124 of the footboard 30. A downwardly extending shroud 156 is connected to the arcuate support 154 through a mounting platform 158. A pair of L-shaped securing brackets 160 are fixed adjacent a lower end of the shroud 156 and threadably receive a pair of bolts 162 for securing the removable cover 126 to the body portion 124 of the footboard 30.

In the illustrated embodiment, the blower 144 is used to supply air to the low air loss mattress 38. If the mattress 38 does not require a blower 144 to supply air, a compressor or other air supply may be located within interior region 128 of footboard 30 instead of the blower 144. In addition, another type of fluid supply, such as a water recirculation unit or a water pump, may be located within the footboard 30, if desired, when a water-filled mattress is used. As such, it should be appreciated that the footboard 30 of the present invention may be utilized with any fluid filled device associated with a patent support apparatus.

Referring further to FIGS. 6 and 8, an inlet filter 166 is coupled to the intake 168 of the blower 144 and filters particulate from the air passing therethrough. The inlet filter 166 is of conventional design and may include a housing 170 fixed to an inner surface 172 of the interior region 128 of the footboard 30, thereby at least partially supporting the blower 144. A manifold 174 is supported within the interior region 128 intermediate the blower 144 and the control valves 146 and 148. As described in greater detail below, the manifold 174 includes a single intake 176 and first and second outlets 178 and 180. The intake 176 receives air from the outlet 181 of the blower 144 which is then divided into two separate air paths passing through the first and second outlets 178 and 180. Conventional flexible tubing 182 and 184 (FIG. 6) interconnects the first and second outlets 178 and 180 with the first and second control valves 146 and 148, respectively.

Figure 12:
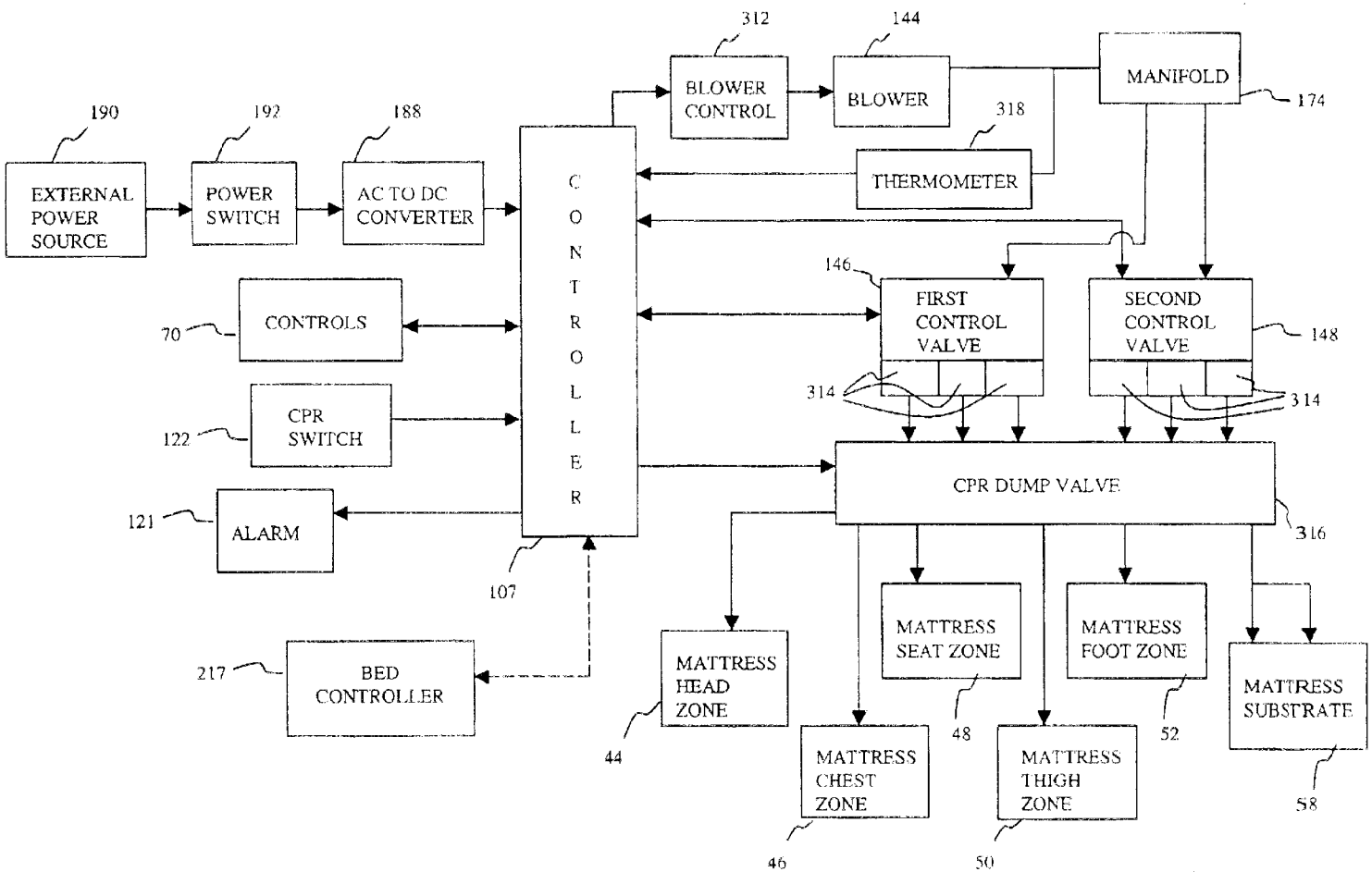
FIG. 12 is a block diagram illustrating the interconnection of the various control and fluid handling components of the removable footboard of FIG. 1.

The controller 107 is illustratively formed as a circuit board and is located within the interior region 128 of the footboard 30. A power supply module 188 is supported within the interior region 128 and is in electrical communication with the controller 107. The power supply module 188 illustratively comprises a conventional alternating current to direct current (AC to DC) converter provided in electrical communication with an external alternating current power source 190 (FIG. 12). A power switch 192 is provided intermediate the external power source 190 and the AC to DC converter 188. The power switch 192 comprises a conventional rocker switch supported by the removable cover 126. A pilot light (not shown) may be provided to indicate that AC input voltage is available to the footboard 30.

The external power source 190 illustratively may be from 95V AC to 240V AC at 50 to 60 Hz. The AC to DC converter 188 produces a 24V DC output that is supplied to the controller 107, which internally generates 5V DC and 12V DC. The 5V DC source is used internally by the controller 107 for logic signals, and externally for a speed control signal for the blower 144 and for set signals for the control valves 146 and 148. The 12V DC may be used as a driver voltage for driving the control valves 146 and 148 and a CPR dump valve 316 (FIG. 12).

A front bumper 194 extends outwardly from the front wall 195 of the removable cover 126. The front bumper 194 includes a resilient contact or engagement member 196 fixed to the front wall 195 and a support 198 positioned within the interior region 128 of the footboard 30. The support 198 includes a body portion 200 coupled to a pair of spaced apart posts 202 and 204. The posts 202 and 204 are secured to the shroud 156 of the mounting member 138 by conventional bolts 206. The resilient engagement member 196 is aligned with the body portion 200 of the support 198 in order to protect the front wall 195 of the removable cover 126 from impact.

The footboard 30 also includes side bumpers 208 and 210 and apertures 212 and 214. The apertures 212 and 214 provide handles to facilitate movement of the bed 10. Illustratively, both the headboard 28 and the footboard 30 are made from a plastic material using a blow molding process. It should be understood, however, that the headboard 28 and footboard 30 may be made from other materials and from other processes, if desired.

Figure 7:
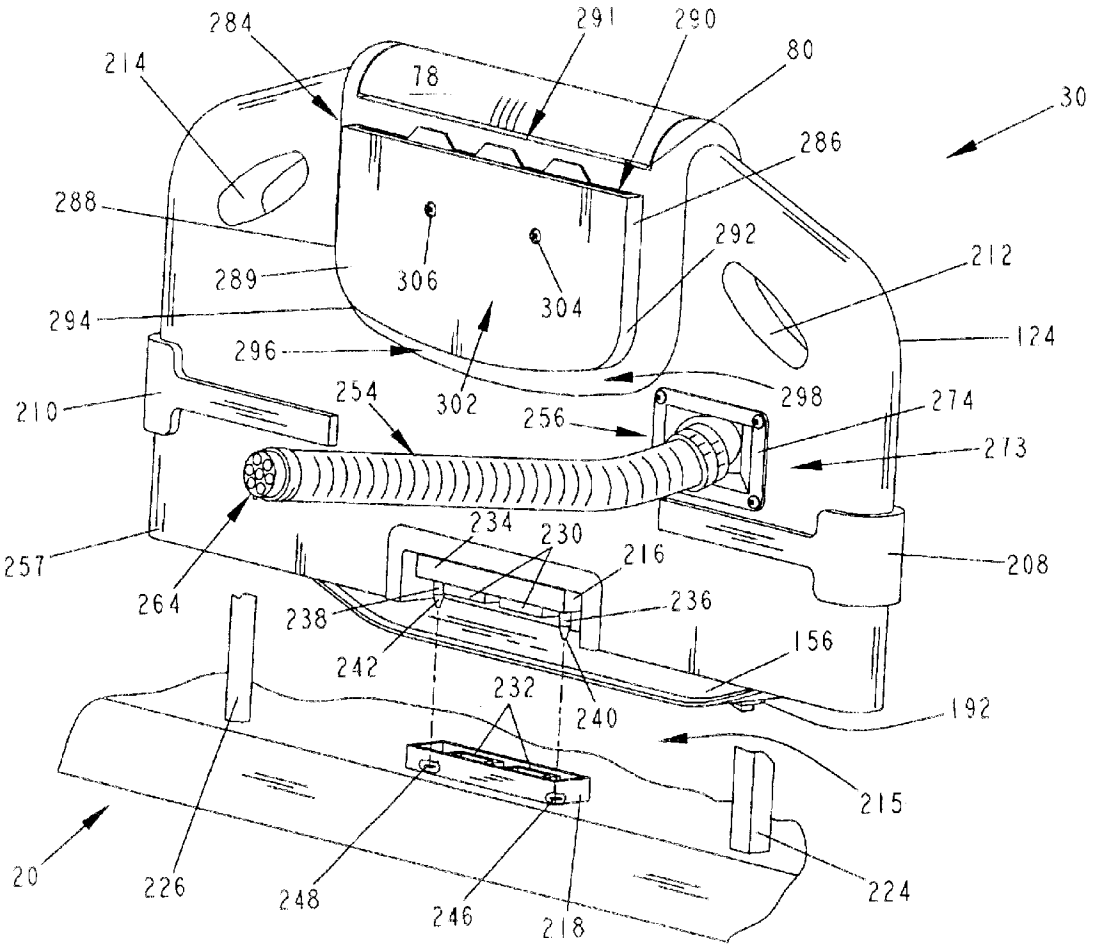
FIG. 7 is a rear perspective view of the removable footboard of FIG. 1 raised above the bed frame, with the support posts and the bed frame partially broken away for clarity.

Referring now to FIGS. 4, 7, and 9, the controls 70 on the footboard 30 are illustratively coupled through a connector assembly 215 to a bed, or second, controller 217 (FIG. 12) supported by the bed 10. As such, the controller 107 of the footboard 30 is electrically coupled to the controller 217 of the bed 10. The bed controller 217 and other bed electronics are illustratively mounted on the frame 20 of the bed 10 as illustrated in U.S. Pat. No. 6,208,250. The connector assembly 215 may also supply power to the power supply module 188. Alternatively, a conventional power cord (not shown) may be wired to the power supply module 188 and plugged into an outlet receptacle (not shown) on the bed 10.

A first connector alignment apparatus 216 is coupled to the footboard 30 and a second connector alignment apparatus 218 is coupled to the frame 20 of the bed 10. The support posts 140 and 142 of the footboard 30 are formed to include apertures 220 and 222 which slide over upwardly extending mounting posts 224 and 226 on the frame 20 during installation of the footboard 30 onto the frame 20 in the direction of arrow 228 in FIG. 4. The apertures 220 and 222 defined by the support posts 140 and 142 are configured to mate with the respective mounting posts 224 and 226 such that the footboard 30 may be mounted to the frame 20 in a single orientation. More particularly, the mounting post 224 has a substantially rectangular cross-section to mate with the substantially rectangular cross-section of the aperture 220 of the support post 140. Likewise, the mounting post 226 has a substantially circular cross-section to mate with the substantially circular cross-section of the aperture 222 of the support post 142. The posts 224 and 226 and the apertures 220 and 222 provide initial alignment between the footboard 30 and the frame 20. The first and second connector alignment apparatuses 216 and 218 provide further alignment for male and female electrical connectors 230 and 232, respectively.

The first connector alignment apparatus 216 is configured to support a pair of male electrical connectors 230, while the second connector alignment apparatus 218 is configured to support a pair of female electrical connectors 232. The first connector alignment apparatus 216 further includes a base plate 234 having outwardly extending alignment posts 236 and 238 located at opposite ends. The posts 236 and 238 each include tapered head portions 240 and 242, respectively (FIGS. 4 and 7). The second connector alignment apparatus 218 includes a body portion 244 formed to include apertures 246 and 248 at opposite ends. The apertures 246 and 248 are configured to receive the posts 236 and 238 of the first connector alignment apparatus 216. Lead-in ramp surfaces 250 and 252 are formed around the apertures 246 and 248 (FIG. 4).

During installation of the footboard 30 on to the frame 20, initial alignment is provided by posts 224 and 226 on the frame 20 extending into the apertures 220 and 222 formed in the footboard 30. As the footboard 30 moves downwardly over the posts 224 and 226, the posts 236 and 238 on the first connector alignment apparatus 216 enter the apertures 246 and 248 in the second connector alignment apparatus 218. The tapered surfaces 240 and 242 on the posts 236 and 238 and the ramp portions 250 and 252 of the apertures 246 and 248 facilitate insertion of the posts 236 and 238 into the apertures 246 and 248. As such, the alignment apparatuses provide an electrical connection to the footboard 30 automatically when the footboard 30 is installed on the frame 20. Additional details of the first and second connector alignment apparatuses are disclosed in U.S. Pat. No. 6,208,250.

Figure 10:
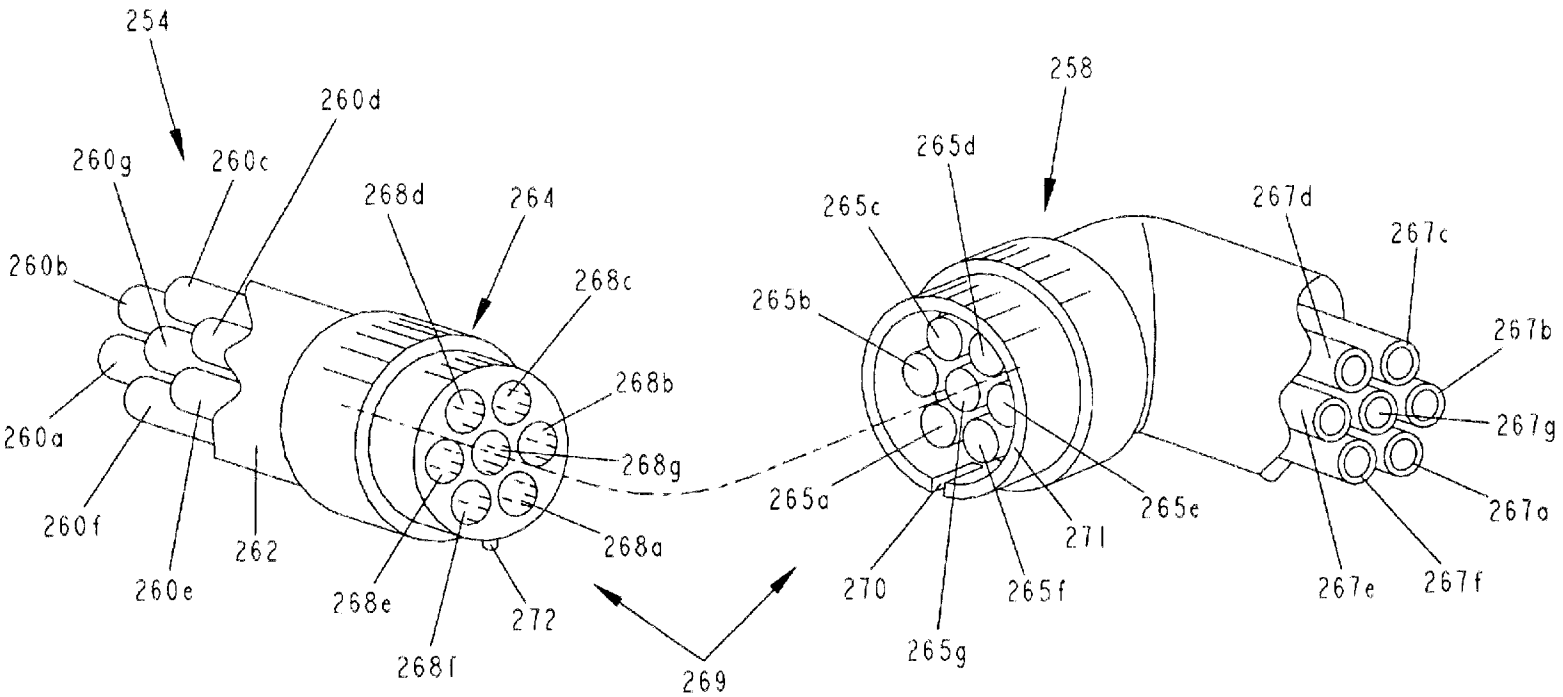
FIG. 10 is a perspective view illustrating the interface coupling of the air hose assembly and the mattress interface connection assembly of FIG. 2.

With reference to FIGS. 2, 3, 7, and 9–12, air is supplied to the mattress 38 from the interior region 128 of the footboard 30 through an air hose assembly 254. The air hose assembly 254 provides fluid communication between a footboard interface connection assembly 256 located on a rear wall 257 of the footboard 30, and a mattress interface connection assembly 258, located on the left foot end of the mattress 38. The air hose assembly 254 comprises a plurality of independent air stream supply tubes 260*a–g* bundled together and nested within an outer tube 262 (FIG. 10). Both ends of the air hose assembly 254 may include an interface coupling 264 so that the air hose assembly 254 may be connected to deliver air from the blower 144 to the mattress 38. Illustratively, the interface couplings 264 on each end of the air hose assembly 254 are identical so that either end of the air hose assembly 254 may be attached to either the footboard interface connection assembly 256 or the mattress interface connection assembly 258.

Figure 11:
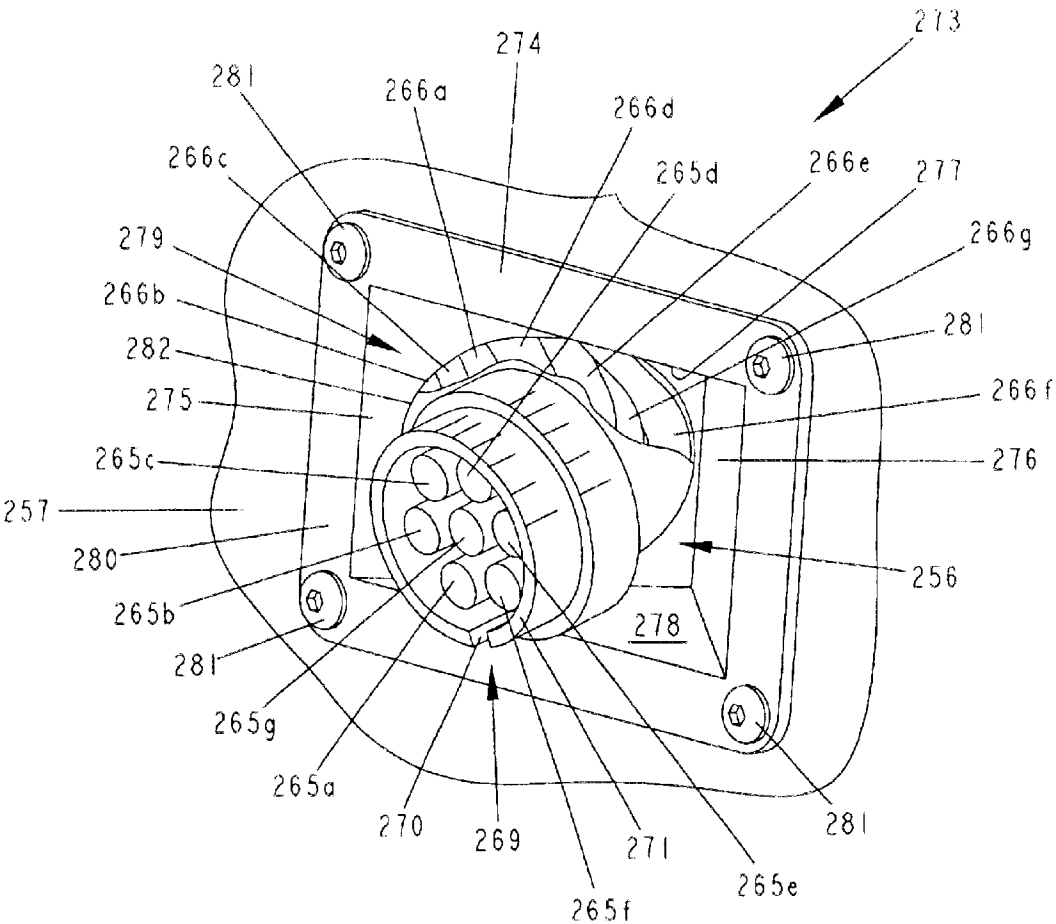
FIG. 11 is a detailed perspective view of the footboard interface connection assembly and the relief member of the removable footboard of FIG. 1.

Referring further to FIGS. 2, 10 and 11, the footboard interface connection assembly 256 and the mattress interface connection assembly 258 are illustratively substantially identical and each include a plurality of male connection members 265*a–g*. The male connection members 265*a–g* of the footboard interface connection assembly 256 are coupled to independent air stream supply tubes 266*a–g*, respectively which in turn are connected to the blower 144 through the first and second control valves 146 and 148 (FIG. 11). The male connection members 265*a–g* of the mattress interface connection assembly 258 is likewise coupled to independent air stream supply tubes 267*a–g*, respectively, which in turn are connected to the air mattress 38. The interface couplings 264 of the air hose assembly 254 illustratively include a plurality of female connection members 268*a–g* coupled to the supply tubes 260*a–g* of the air hose assembly 254, respectively. The footboard interface connection assembly 256 and the mattress interface connection assembly 258 sealingly mate with the interface couplings 264 of the air hose assembly 254. More particularly, the male connection members 265*a–g* are sealingly received within the female connection members 268*a–g*, thereby providing fluid communication between the interface connection assemblies 256 and 258 and their respective interface couplings 264.

An alignment mechanism 269 ensures proper orientation of the connection assemblies 256 and 258 relative to their respective interface couplings 264. The alignment mechanism 269 includes a slot 270 formed within a coupling ring 271 of each interface connection assembly 256 and 258, and a pin 272 coupled to each of the interface couplings 264. As may be appreciated, the slot 270 slidingly receives the pin 272 only when the connection assembly 256 and 258 is in a single, proper orientation relative to the respective interface coupling 264.

Additional details of the air hose assembly 254, including the interface connection assemblies 256, 258 and the interface couplings 264, are provided in U.S. Pat. No. 5,647,079.

Referring further to FIGS. 7, 8, and 11, the footboard interface connection assembly 256 is received within a relief member 273 supported by the rear wall 257 of the footboard 30. The relief member 273 includes a housing 274 extending inwardly from the rear wall 257 toward the interior region 128 of the footboard 30. The housing 274 includes first and second inclined sidewalls 275 and 276 connected to upper and lower walls 277 and 278, thereby defining a relief or recess 279. A mounting flange 280 is connected to the rear wall 257 through conventional fasteners, such as bolts 281. The footboard interface connection assembly 256 is supported by an aperture 282 formed within the first inclined wall 275.

Referring now to FIGS. 2, 7, and 8, the footboard 30 further includes an instruction receptacle 284 supported by the rear wall 257 of the footboard 30. The instruction receptacle 284 includes a pair of side walls 286 and 288 coupled to an outer wall 289 and defining an interior region 290. An upper end 291 of the instruction receptacle 284 is open to provide access to the interior region 290. Each of the side walls 286 and 288 includes an arcuate lower portion 292 and 294 which defines a fluid passage 296. The arcuate lower portions 292 and 294 are configured to direct fluids downwardly toward the lower end 298 of the instruction receptacle 284 and out through the fluid passage 296.

A plurality of cards 300 are illustratively received within the interior region 290 of the instruction receptacle 284. The cards 300 may comprise instruction sheets for use by a caregiver positioned adjacent to the footboard 30. A guide member 302 is associated with the cards 300 and is configured to guide the cards 300 in movement from within the interior region 290 through the open upper end 291. The guide member 302 illustratively includes a pair of pins 304 and 306 slidably received within a pair of slots 308 and 310 formed within each of the plurality of cards 300 (FIG. 8).

Operation of the air supply components of the footboard 30 is represented schematically in FIG. 12. Upon activation of the power switch 192, AC power is supplied by the external power source 190 to the AC to DC converter 188. Desired settings for the air mattress 38 may be entered through controls 70 on the lower inclined control panel 76, which is in communication with the controller 107. The controller 107 activates the blower 144 and the control valves 146 and 148 as required to maintain desired pressures within the zones 44, 46, 48, 50, 52, and 58 of the air mattress 38.

A conventional blower control 312 provides an interface between the blower 144 and the controller 107. More particularly, the AC to DC converter 188 provides 24V DC to the blower control 312, which is used to generates the necessary stepper signals to run the blower 144. A 0V DC to 5V DC blower speed signal is supplied to the blower control 312 by the controller 107. When operating in a standard condition, the blower speed signal is approximately 4 V DC.

The blower 144 draws air from the atmosphere through the intake 135 formed in the removable cover 126. The air passes through the inlet filter 166 and into the blower 144 through the intake 168. Air is forced out of the blower 144 through the outlet 181 and then into the manifold 174.

The manifold 174 supplies the pressurized air stream to control valves 146 and 148. More particularly, the air stream enters the manifold 174 through the intake 176 and is then separated to pass through the first outlet 178 and the second outlet 180. Tubing 182 and 184 directs the separated air streams to the first and second control valves 146 and 148. Each control valve 146 and 148 illustratively comprises three zone proportional valves 314. As the separated air streams pass through the control valves 146 and 148, they are further divided into a total of six independent air streams. The number of proportional valves 314 equals the number of independent air streams to be directed to the mattress 38. As may be appreciated, the number of proportional valves 314 may be varied depending upon the number of separately inflatable air bladders or bags included within the mattress 38.

The pressure of each independent air stream, and therefore air mattress zone 44, 46, 48, 50, 52 and 58, is regulated by the opening and closing of its respective proportional valve 314. Illustratively, the proportional valves 314 automatically adjust in response to a signal received from the controller 107, so that their actual output pressures substantially match desired output pressures. The comparison between actual output pressures and desired output pressures is carried out for each valve by a conventional microprocessor (not shown) within the controller 107. Actual output pressures are measured using pressure transducers (not shown) located at the proportional valves 314. The desired output pressures are calculated by the microprocessor based upon the inputs received from the controls 70 on the footboard 30. The desired output pressure may be generated by the controller 107 based upon a patient's height and weight.

In addition to monitoring the controls 70 on the footboard 30 and controlling the operation of the proportional valves 314, the controller 107 controls the speed of the blower 144. When the microprocessor of the controller 107 detects that the actual output pressure at a valve 314 is less than the desired output pressure, the controller 107 signals one of the valves 314 to open so that the actual pressure increases. If the pressure in the manifold 174 is insufficient to increase the actual output pressure after the opening of the valve 314, the controller 107 signals the blower control 312 to increase the speed of the blower 144. Then, as the actual output pressure increases, and the desired output pressure is exceeded, the controller 107 decreases the flow of valve 314 and reduces the speed of the blower 144.

When a zone proportional valve 314 is unable to match the desired pressure with the correct amount of air pressure, the controller 186 will send an alarm signal to the alarm 121. The alarm 121 will provide an audible signal which may be temporarily silenced by depressing the alarm silence button 120.

The temperature of air supplied by the blower 144 is monitored by a thermometer, illustratively a thermistor 318. The thermistor 318 is continually monitored by the controller 107 for continuity to ensure that it has not been opened. As the temperature of the air supplied by the blower 144 rises, the resistance of the thermistor 318 decreases, allowing a voltage signal back to the controller 107 to increase. An alarm condition is activated if the thermistor opens, or if the measured air temperature rises above a predetermined temperature. Illustratively, the predetermined temperature is approximately 150° F. (66° C.), which is based on providing an air temperature to the mattress 38 below approximately 105° F. (41° C.). During the alarm condition, the controller 107 disables the blower 144, illuminates a "service required" indicator light 96 on the central inclined panel 74, and activate the audible alarm 121.

The independent air streams pass from the proportional valves 314 through a CPR dump valve 316, and then into the air supply tubes 260*a–g* of the air hose assembly 254. The CPR dump valve 316 is an electronically controlled valve actuable to vent all of the independent air streams to the atmosphere simultaneously while air flow from the manifold 174 is stopped. To engage the CPR feature, a caregiver enters a command on the control panel or activates the CPR button 122 located on the housing 124. This sends a signal to the controller 107 to open the CPR valve 316 and to stop the flow of air from the manifold 174. The present invention also provides that a manual CPR condition may be accomplished by disconnecting the hose assembly 254 from either the footboard 30, thereby allowing air to escape from the mattress 38. The net result of either manner of operation is the rapid deflation under the weight of the patient of all of the zones 44, 46, 48, 50, 52 and 58 of the mattress 38.

In the illustrated embodiment, the footboard 30 and the blower 144, or other fluid supply, are formed integrally as a single unit. Therefore, it is not required to couple a separate blower housing to the footboard 30 or other part of the bed 10 in order to supply air to the mattress 38. In the present invention, the bed 10 illustrated in U.S. Pat. No. 6,208,250 is used with a conventional foam, inner spring or static air mattress. When it is desired to switch the conventional mattress to a dynamic air mattress, the footboard shown in U.S. Pat. No. 6,208,250 is removed and replaced with the footboard 30 shown in the present application. This provides an integral blower 144, or other fluid supply, for the mattress 38 supported within the footboard 30 on the bed 10.

Although the blower 144 is illustratively located within the footboard 30, it is understood that the blower 144, or other fluid supply, may be located in an interior region of the headboard 28 or in an interior region of one of the siderails 32 and 34. The headboard 28, the footboard 30, and the siderails 32 and 34 illustratively provide barriers which extend above the top surface 36 of mattress 38 and which are coupled to the frame 20 or articulating deck 22 of the bed 10. Therefore, the present invention provides a fluid supply, such as blower 144, located within an interior region of a barrier coupled to a hospital bed 10.

In an illustrative embodiment of the present invention, the footboard 30 includes access panels or doors 320 configured to cover internal chambers 322. More particularly, the access doors 320 are pivotally coupled to the front wall 195 of the removable cover 126 utilizing conventional mechanisms, such as hinges (not shown). Alternatively, the access doors 320 may be supported for sliding movement relative to the front wall 195 for providing access to the internal chambers 322. The interior region 128 of the footboard 30 is configured to provide space for the internal chambers 322 to extend therein.

The chambers 322 are illustratively configured to receive control modules 324. The control modules 324 include electrical connectors and valves (not shown) for providing various types of therapy to a patient supported on the bed 10. For example, different control modules 324 can be provided for rotation therapy, percussion/vibration therapy, sequential compression therapy, or other type of therapy. Details of the control modules 324 are included in U.S. Pat. Nos. 5,715,548 and 6,047,424, and in U.S. patent application Ser. No. 09/532,592, all of which are assigned to the assignee of the present invention and are expressly incorporated by reference herein. In addition, the doors 320 can provide access to storage chambers 322 for storing other items, such as medical supplies, within the interior region 128 of the footboard 30.

In another illustrative embodiment of the present invention, a compression boot or other compression device (not shown) is stored within interior region 128 of the footboard 30 and is accessible through the door 320 on the footboard 30. If necessary, a separate compressor (not shown) for the compression device may also be stored in interior region 128 of footboard 30. The compression device is removable from the interior region 128 to provide therapy to the patient supported on the mattress 38.

Although the invention has been described in detail with reference to certain illustrated embodiments, variations and modifications exist within the scope and spirit of the invention as described and as defined in the following claims.

What is claimed is:

1. A barrier apparatus configured to be coupled to a patient support including a mattress having a top surface configured to support a person thereon, the barrier apparatus comprising:

a housing configured to define an interior region;

a fluid supply located in the interior region of the housing, the fluid supply being coupled to a fluid filled device; and a coupler configured to secure the housing to the patient support so that the housing is located adjacent the mattress with a portion of the housing extending above the top surface of the mattress to provide a barrier for the person on the top surface of the mattress.

2. The apparatus of claim 1, wherein the housing is formed by one of a footboard, a headboard, and a siderail.

3. The apparatus of claim 1, further comprising at least one valve located within the interior region of the housing, the valve being configured to direct fluid to the fluid filled device.

4. The apparatus of claim 1, further comprising a controller coupled to the fluid supply, the controller being located within the interior region of the housing.

5. The apparatus of claim 4, further comprising a second controller coupled to patient support, the second controller being electrically coupled to the controller in the interior region of the housing.

6. The apparatus of claim 1, wherein the housing is removable from the patient support.

7. The apparatus of claim 6, further comprising a first connector located on the housing and a second connector located on the patient support, the first connector being configured to mate with the second connector to provide an electrical connection to the housing when the housing is installed on the patient support.

8. The apparatus of claim 1, wherein the fluid supply is one of a blower and a compressor.

9. The apparatus of claim 1, wherein the fluid supply is a water pump.

10. The apparatus of claim 1, wherein the housing includes a receptacle formed in the interior region and configured to receive an accessory item therein.

11. The apparatus of claim 1, wherein the housing includes a fluid intake aperture to supply fluid to the fluid supply through the housing.

12. The apparatus of claim 1, further comprising a therapy control module coupled to the housing to provide a therapy to the person.

13. The apparatus of claim 12, wherein the therapy control module is located in the interior region of the housing.

14. The apparatus of claim 1, wherein the fluid filled device is an air mattress.

15. The apparatus of claim 1, wherein the fluid filled device is a therapy device.

16. A barrier apparatus configured to be coupled to a patient support including a mattress having a top surface configured to support a person thereon, the barrier apparatus comprising:

a housing including a front wall, a rear wall, and a cavity formed intermediate the front wall and the rear wall;

a bumper extending outwardly from the front wall, the bumper including a support located in the cavity and extending toward the front wall of the housing; and a coupler configured to secure the housing to the patient support so that the housing is located adjacent the mattress with a portion of the housing extending above the top surface of the mattress to provide a barrier for the person on the top surface of the mattress.

17. The apparatus of claim 16, wherein the bumper further includes a resilient engagement member aligned with the support and extending outwardly from the front wall.

18. The apparatus of claim 16, wherein the support includes a body portion coupled to a pair of support posts.

19. The apparatus of claim 16, wherein the front wall concaves outwardly away from the rear wall.

20. The apparatus of claim 16, further comprising a mounting bracket supported within the cavity intermediate the front wall and the rear wall of the housing.

21. The apparatus of claim 20, wherein the support of the bumper is coupled to the mounting bracket.

22. The apparatus of claim 16, further comprising a fluid supply located in the cavity of the housing, the fluid supply being coupled to a fluid filled device.

23. The apparatus of claim 22, further comprising at least one valve located within the interior region of the housing, the valve being configured to direct fluid to the fluid filled device.

24. The apparatus of claim 16, wherein the housing is formed by one of a footboard, a headboard, and a siderail.

25. The apparatus of claim 16, wherein the housing is removable from the patient support.

26. The apparatus of claim 25, further comprising a first connector located on the housing and a second connector located on the patient support, the first connector being configured to mate with the second connector to provide an electrical connection to the housing when the housing is installed on the patient support.

27. A footboard configured to be coupled to a patient support including a mattress having a top surface configured to support a person thereon, the footboard comprising:

a body including an outer surface;

a fluid outlet formed within the outer surface of the body; and a coupler configured to secure the body to the patient support so that the body is located adjacent the mattress with a portion of the body extending above the top surface of the mattress to provide a barrier for the person on the top surface of the mattress.

28. The footboard of claim 27, further comprising a fluid inlet formed within the outer surface of the body, the fluid inlet being in fluid communication with the fluid outlet.

29. The footboard of claim 27, wherein the fluid outlet includes a tubular member extending outwardly from the outer surface of the body.

30. The footboard of claim 29, wherein the tubular member comprises a flexible hose including a plurality of fluid lines.

31. The footboard of claim 29, further comprising a relief member supported by the outer surface of the body, the tubular member passing through the relief member.

32. The footboard of claim 27, further comprising a fluid supply supported by the body, the fluid supply being coupled to a fluid filled device by the fluid outlet.

33. The footboard of claim 32, wherein the fluid outlet includes a first set of fluid connectors configured to couple with a second set of fluid connectors supported by the fluid filled device.

34. The footboard of claim 33, wherein the fluid outlet further comprises an alignment member so that the first and second sets of connectors can be coupled together in a single orientation.

35. The footboard of claim 32, further comprising at least one valve supported by the body, the valve being configured to direct fluid to the fluid filled device.

36. The footboard of claim 27, wherein the outer surface of the body includes a front surface and a rear surface, a bumper being supported by the front surface, and the fluid outlet being supported by the rear surface.

37. The footboard of claim 27, wherein the footboard is removable from the patient support.

38. The footboard of claim 27, further comprising a first electrical connector located on the body and a second electrical connector located on the patient support, the first electrical connector being configured to mate with the second electrical connector to provide an electrical connection to the body when the body is installed on the patient support.

39. A barrier apparatus configured to be coupled to a patient support including a mattress having a top surface configured to support a person thereon, the barrier apparatus comprising:

a body;

an instruction receptacle coupled to the body, the instruction receptacle including a pair of side walls defining an interior region, an open upper end in communication with the interior region, and an opposing lower end including a fluid passage in communication with the interior region; and a coupler configured to secure the body to the patient support so that the body is located adjacent the mattress with a portion of the body extending above the top surface of the mattress to provide a barrier for the person on the top surface of the mattress.

40. The apparatus of claim 39, further comprising a guide member, and a plurality of cards being coupled to the guide member for movement from within the interior region through the open upper end of the instruction receptacle.

41. The apparatus of claim 40, wherein the guide member includes a pin supported within the interior region of the instruction receptacle, each of the plurality of cards including a slot configured to slidably receive the pin.

42. The apparatus of claim 39, wherein the body is formed by one of a footboard, a headboard, and a siderail.

43. The apparatus of claim 39, wherein the pair of side walls each include an arcuate lower portion configured to direct fluid downwardly toward the fluid passage in the lower end of the instruction receptacle.

44. The apparatus of claim 39, further comprising a fluid supply supported by the body, the fluid supply being coupled to a fluid filled device.

45. The apparatus of claim 44, further comprising at least one valve supported by the body, the valve being configured to direct fluid to the fluid filled device.

46. The apparatus of claim 39, wherein the barrier is removable from the patient support.

* * * * *